US008917186B1

(12) United States Patent
Grant

(10) Patent No.: US 8,917,186 B1
(45) Date of Patent: Dec. 23, 2014

(54) AUDIO MONITORING AND SOUND IDENTIFICATION PROCESS FOR REMOTE ALARMS

(71) Applicant: State Farm Mutual Automobile Insurance Company, Bloomington, IL (US)

(72) Inventor: Rosemarie Geier Grant, Ellsworth, IL (US)

(73) Assignee: State Farm Mutual Automobile Insurance Company, Bloomington, IL (US)

( * ) Notice: Subject to any disclaimer, the term of this patent is extended or adjusted under 35 U.S.C. 154(b) by 0 days.

(21) Appl. No.: 14/196,531

(22) Filed: Mar. 4, 2014

(51) Int. Cl.
*G08B 25/08* (2006.01)
*G08B 3/10* (2006.01)

(52) U.S. Cl.
CPC ..... *G08B 3/10* (2013.01)
USPC ..... 340/692; 340/506; 340/521; 340/531; 340/540; 340/541; 340/3.3; 340/3.5; 348/143

(58) Field of Classification Search
CPC ..... G08B 29/00; G08B 13/1672
USPC ..... 340/692, 506, 521, 531, 540, 541, 3.3, 340/3.5; 348/143
See application file for complete search history.

(56) References Cited

U.S. PATENT DOCUMENTS

2008/0215334 A1* 9/2008 Gandhi et al. ..... 704/273
2010/0277315 A1* 11/2010 Cohn et al. ..... 340/540

* cited by examiner

*Primary Examiner* — Tai T Nguyen
(74) *Attorney, Agent, or Firm* — Marshall, Gerstein & Borun LLP

(57) ABSTRACT

In a computer-implemented method for remote monitoring of one or more alarms, an audio signal is received. The received audio signal is processed using an audio recognition technique to identify an alarm that generated the audio signal. A user is caused to be notified that the identified alarm has been triggered.

10 Claims, 5 Drawing Sheets

AUDIO MONITORING AND SOUND IDENTIFICATION PROCESS FOR REMOTE ALARMS

TECHNICAL FIELD

The present application relates generally to alarm systems and, more specifically, to systems and methods for identifying an alarm that has been triggered, generating an alarm, and/or notifying a user that an alarm has been triggered.

BACKGROUND

Within the typical home, various different alarm devices are installed in order to prevent property loss or damage, and/or to prevent loss of life or other injury. For example, fire or smoke detectors, carbon monoxide detectors, water leak detectors and home security systems (e.g., devices that monitor motion, and/or open doors or windows, to detect trespassers/break-ins) are some of the more common alarm types that are commonly employed in the home. To alert a home owner (or renter, guest, etc.) to a high-risk situation, these alarms typically generate and emit very loud tones or other audio signals that can easily be heard throughout the home. If no one is present in the home when an alarm is triggered, however, the alarm may go unnoticed. While some home security systems remotely notify a home owner when a potential break-in or other trespass has occurred (e.g., when a sensor detects motion), these systems typically utilize dedicated hardware and/or software that cannot be used for other alarms in the home, and require entering into a contract with the company that provided the home security system product/devices. Moreover, remote monitoring/notification services of this sort are typically not offered at all for other types of alarm devices, such as stand-alone smoke or carbon monoxide detectors.

Further, conventional alarm devices and systems are unable to determine many conditions/situations that a home owner, if present in the home, would be likely to associate with a high level of risk. For example, conventional alarms are not triggered by the sound of glass breaking, by loud yet unidentifiable noises, or by other sounds/noises that would likely cause an individual present in the home to investigate and/or request assistance (e.g., call 911).

DETAILED DESCRIPTION

In one embodiment, the disclosed system monitors sounds/noises within the home to determine whether an alarm has been triggered. To establish alarm identification capability, the system may first undergo a training procedure in which the different audio signals generated by different alarms in the home are recorded and/or analyzed, and are associated with the respective alarm type and/or location (e.g., "carbon monoxide detector," "smoke detector," "smoke detector in basement," "water leak detector in laundry room," etc.). Once the various alarm audio signals have been learned, the system may perform audio processing to determine whether a detected sound was generated by one of the known alarms. If a particular alarm is identified as having been triggered, the system may then notify an absent home owner/resident via a text message, an electronic mail (email) message, or in another suitable manner.

In another embodiment, the disclosed system monitors sounds/noises within the home to determine whether any sound/noise is a cause for concern. In this embodiment, the system may be trained by analyzing ambient sounds/noises within the home over a relatively long time period (e.g., one hour, 24 hours, one week, etc.) in order to generate an "ambient noise profile" for the home. Thereafter, if a sound is determined to be sufficiently different from or unusual with respect to the ambient noise profile, the system may notify the absent home owner/resident. For example, the sound of an "overworked" sump pump, the sound of an automatic generator switching on, or the chirp of a furnace might be different enough from the ambient noise profile to trigger a notification/alert.

Figure 1:
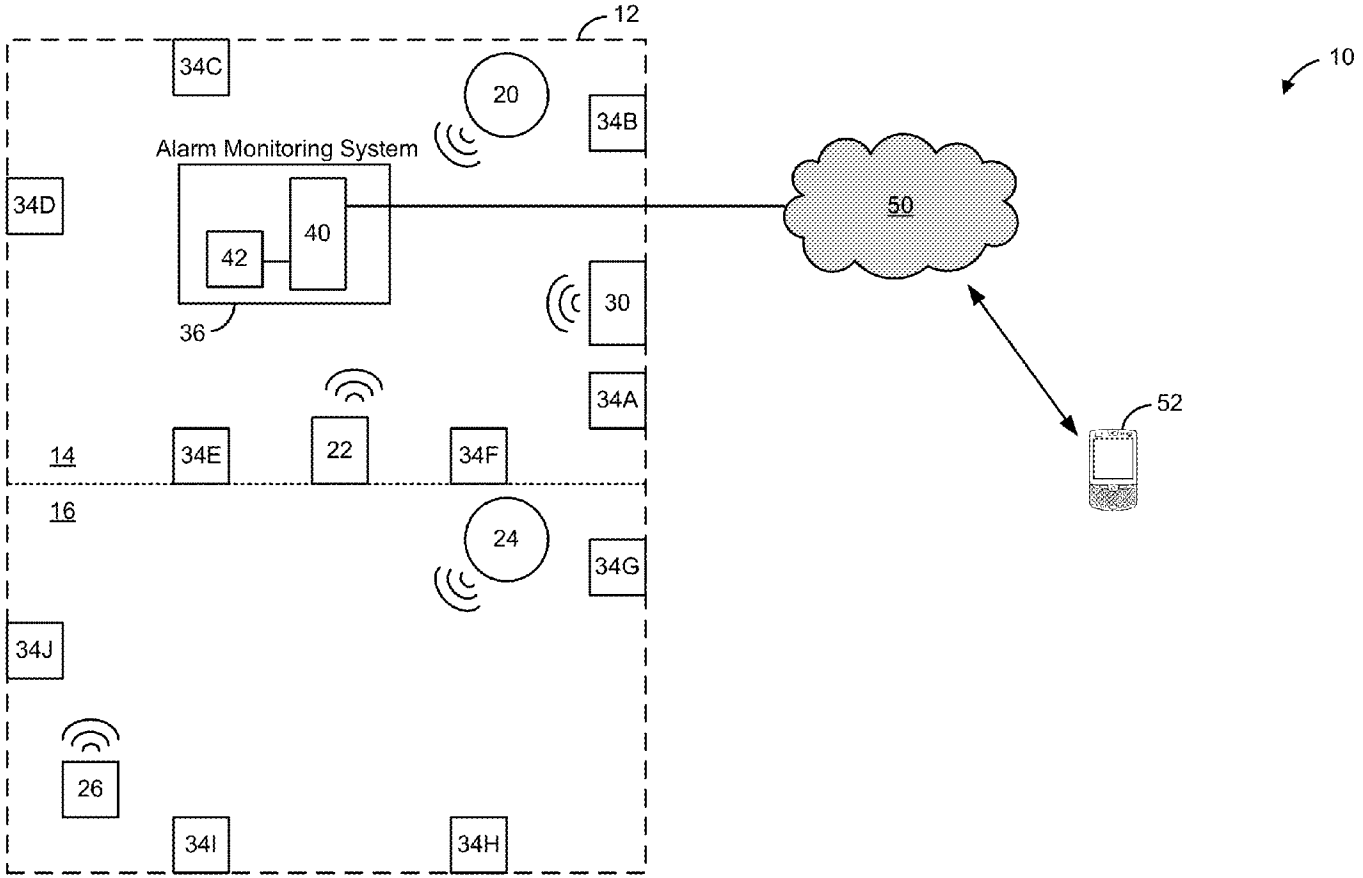
FIG. 1 is a block diagram of an example system for providing an alarm notification to an absent home owner/resident, according to an embodiment.

FIG. 1 is a block diagram of an example system 10 for providing an alarm notification to an absent home owner/resident, according to an embodiment. In the system 10, an example home 12 includes a first level 14 (e.g., a ground floor) and a second level 16 (e.g., a basement or upper floor of the home 12). While some descriptions below refer to a "home," it is noted that in various embodiments and/or scenarios home 12 may be any sort of residential or non-residential structure with any number of levels/floors, such as a commercial building, or even a particular outdoor area, for example. Further, while some descriptions below refer to a "home owner" or "home owner/resident," it is noted that in various embodiments and/or scenarios the individual may instead be any other person, such as a landlord, store manager, call center employee, etc.

The home 12 includes various installed alarm devices/systems, including a smoke detector 20 and carbon monoxide detector 22 located on the first level 14, and a second smoke detector 24 and water leak detector 26 located on the second level 16. Each of the detectors 20, 22, 24, 26 is configured to generate a respective audio signal (e.g., a loud tone or set of tones, a synthesized or recorded verbal warning, etc.) when the corresponding alarm condition is detected (e.g., a threshold amount of smoke, carbon monoxide, door/window, or water). Also installed within the home 12 is a home security system that includes a controller 30 located on the first level 14, and a plurality of sensors 34A-34E that are coupled to the controller 30 (e.g., via wired or wireless connections not shown in FIG. 1). A home owner/resident may configure the home security system via a keypad or touchscreen on controller 30, for example, and the controller 30 may support multiple alarm modes each corresponding to a different set of conditions for triggering an alarm. For example, a first, "at home" mode (i.e., intended for times when a home owner/resident is at the home 12) may cause the controller 30 to trigger the alarm only if a door or window is opened. Conversely, a second, "not at home" mode may cause the controller 30 to trigger the alarm not only if a door or window is opened, but also if motion is detected within the home 12. To determine whether conditions such as these are satisfied, the sensors 34A-34J may include motion detectors, door sensors, window sensors, and/or other devices, with each device of the sensors 34A-34J providing sensor data to the controller 30 indicating whether the respective condition (motion, door or window in an open position, etc.) has been sensed. In one embodiment, for example, sensor 34A detects whether a door providing access to the home 12 is open, sensors 34A-34E, 34H and 34J detect whether respective windows of the home 12 are open, and sensors 34F and 34J detect motion on the first level 14 and second level 16, respectively, of home 12. When the home security system alarm has been triggered, the controller 30 generates/emits an audio signal (e.g., a loud tone or set of tones, an oscillating tone, a synthesized or recorded verbal warning, etc.) when any one of sensors 34A-34J detects the corresponding alarm condition. In other embodiments and/or scenarios, the home 12 includes more, fewer, or different types of alarm devices/systems than are shown in FIG. 1. For example, the home 12 may include alerts associated with mechanical equipment such as a furnace (e.g., for a high temperature condition or a dirty filter) or an appliance (e.g., dishwasher).

Also located in the home 12 is an alarm monitoring system 36. In the example system 10 of FIG. 1, the alarm monitoring system 36 includes a computer 40 as well as an audio detection module 42 having audio sensor capabilities (e.g., one or more microphones). The computer 40 may be a desktop, laptop, touch pad, or other type of general-purpose computer, for example. As another example, the computer 40 may be a computing device that is dedicated to alarm monitoring. In one embodiment, the computer 40 is coupled to the audio detection module 42 via a USB cable/ports. In other embodiments, the computer 40 is coupled to the audio detection module 42 via a different, suitable type of wired or wireless connection. Moreover, in some embodiments, multiple audio detection modules similar to audio detection module 42 may be used (e.g., to ensure adequate audio detection even within a large house or other building, and/or even if soundproof partitions divide the different portions of the house/building). While the embodiments below are, for ease of explanation, described with reference to only a single audio detection module 42, it is understood that the alarm monitoring system 36 may include additional, similar modules that are coupled to computer 40. In yet another embodiment, the audio detection module 42 is included within the computer 40 (e.g., computer 40 may include an audio sensor, and the functions of the audio detection module 42 described below may be implemented by one or more general purpose processors that execute software instructions stored in a memory of the computer 40). While FIG. 1 is described herein with general reference to operations of the alarm monitoring system 36 as a whole, it is noted that, in different embodiments, each of the various functions may be performed by the computer 40, the audio detection module 42, or a combination of the two. Particular examples of how functionality may be divided between the computer 40 and the audio detection module 42 are provided below in connection with FIG. 2.

The alarm monitoring system 36 is communicatively coupled to a network 50 in any suitable manner (e.g., via a network interface card in computer 40, a router, a modem, etc.). The network 50 may be a single network, or may include multiple networks of one or more types (e.g., a wireless local area network (WLAN), the Internet, a public switched telephone network (PSTN), a cellular telephone network, etc.). Via the network 50, the alarm monitoring system 36 is communicatively coupled to a smart phone 52, which may be carried by the owner/resident of home 12 when absent from the home 12. In other embodiments, the smart phone 52 is instead a touch pad computer, laptop computer, or other suitable, portable computing device. In still other embodiments, the smart phone 52 is instead a remote, non-portable computer, such as a desktop personal computer located at either a call center or a workplace of the home owner/resident, for example.

The operation of the example system 10 will now be described according to two different modes, referred to herein as the "alarm identification mode" and the "alarm generation mode," respectively.

In the "alarm identification mode," the alarm monitoring system 36 is initially trained to recognize the audio signals generated by one or more of the various alarm devices/systems in the home 12. Generally, the alarm monitoring system 36 may "learn" the sound of each alarm by recording and/or processing the audio signal generated by the alarm, and by receiving an input (e.g., entered by the home owner/resident) that identifies the alarm that generated the audio signal. In one embodiment and scenario, for example, the user utilizes a user interface of computer 40 to create an entry for a new alarm, to enter the description "smoke detector, ground floor" for the new alarm, and to indicate that the new alarm is about to be triggered. Shortly thereafter, the user may press a "test" button on smoke detector 20, allowing the alarm monitoring system 36 to detect the audio signal generated/emitted by the smoke detector 20.

In one embodiment, the alarm monitoring system 36 records the audio signal (e.g., stores a digital recording of the audio signal), and associates the recorded audio signal with the alarm description entered by the user. In another embodiment, the alarm monitoring system 36 processes the audio signal to generate alarm identification data indicative of the audio signal, stores the alarm identification data, and associates the alarm identification data with the alarm description entered by the user. For example, the alarm monitoring system 36 may process the audio signal to identify metrics/parameters that uniquely identify the audio signal within the home 12, such as tone frequency or frequencies, period or rate of repeated tones, average and/or peak signal strength of the audio signal, and/or any other suitable metrics/parameters. As another example, a more complex algorithm may be used to generate a "fingerprint" from the audio signal waveform, and fingerprint data is then stored and associated with the alarm description. In some embodiments, techniques similar to those currently used for song recognition (e.g., in smart phone applications) may be used to generate data indicative of the audio signal.

In an embodiment, the training process described above is repeated for each of multiple alarms within the home, with the user entering the appropriate description (e.g., alarm type and/or location) for each alarm that is triggered and recorded or processed by alarm monitoring system 36. As just a few examples, the user may enter "carbon monoxide," "carbon monoxide detector" or "carbon monoxide detector, ground floor" for carbon monoxide detector 22, "smoke," "smoke detector" or "smoke detector, basement" for smoke detector 24, "water leak," "water leak detector" or "water leak detector, laundry room" for water leak detector 26, and/or "motion," "open window," "open door," or "home security system" for controller 30 and sensors 34A-34J. For each alarm, the alarm monitoring system 36 records and/or processes the audio signal, and associates the recording or the generated alarm identification data with the corresponding alarm description, e.g., in the manner described above with respect to smoke detector 20.

In an alternative embodiment, the training phase is not performed by alarm monitoring system 36, but rather using a smart phone (e.g., smart phone 52). In this embodiment, the home owner/resident may first download an application to his or her smart phone. The smart phone application may provide a user interface allowing the home owner/resident to enter the various alarm descriptions, and to indicate when each alarm is about to be triggered. The smart phone application may also utilize a microphone of the smart phone to detect the audio signal of each alarm, and cause the smart phone to record the audio signals and/or process the audio signals to generate the alarm identification data in the manner described above. In an embodiment, the recorded audio signals (and/or alarm identification data), the alarm descriptions, and the association data (i.e., data indicating which audio signal is associated with which alarm description) is then transferred from the smart phone to alarm monitoring system 36. The transfer may be made via network 50, via a WiFi network in the home 12, via a wired connection (e.g., USB ports), or in another suitable manner.

Using a smart phone to gather data for the alarm monitoring system 36 may provide certain advantages. For example, it may be more convenient for a home owner/resident to trigger the various alarms and enter the corresponding data on the smart phone while moving throughout the home, rather than repeatedly returning to a stationary location (e.g., in an embodiment where it would be inconvenient to move alarm monitoring system 36) after triggering each alarm. Regardless of whether alarm monitoring system 36 or a smart phone is used for training, however, it may be advantageous to record all audio signals during the training phase from the location at which the alarm monitoring system 36 will be located after training has been completed (i.e., during monitor mode, discussed below). If this is done, audio signals recorded during the training phase (or alarm identification data generated based on those audio signals) may contain information sufficient to distinguish two otherwise identical alarms at different locations within the home 12. Even if smoke detectors 20 and 24 generate the same audio signal, for example, the two may be distinguishable if the alarm identification data includes signal strength data, directionality data (e.g., if audio detection module 42 includes at least two physically separated microphones) and/or multi-path delay (echo) data, etc.

After alarm monitoring system 36 has been trained to recognize all desired alarms within the home 12, the home owner/resident may set the alarm monitoring system 36 to a monitor mode. In the monitor mode, alarm monitoring system 36 listens to audio signals that are detectable at the position of audio detection module 42. In various embodiments, the alarm monitoring system 36 listens continuously, periodically (e.g., for two consecutive seconds once every five seconds, etc.), or on another suitable schedule (e.g., for one second every three seconds, or for a longer duration if a sufficiently strong audio signal is received during that one second, etc.), and processes the detected sounds.

Alarm monitoring system 36 processes the detected audio signals using an audio recognition technique in order to determine whether a match exists with any of the audio signals that were generated by the alarms during the training process. In most situations, of course, the alarm monitoring system 36 will only detect, if anything, audio signals corresponding to sounds that are typically heard within the home environment, such as human conversation, television, laundry machine or dishwater noises, footsteps, sounds of vehicles passing nearby, etc. In such situations, the alarm monitoring system 36 will not match the detected sounds to any alarm in the home 12. In an embodiment, alarm monitoring system 36 conserves processing power by only performing certain processing operations for received audio signals if certain criteria are first determined to exist based on some initial, less-intensive processing of those audio signals. For example, a set of multiple parameters/metrics may only be calculated for audio signals received during monitor mode (and compared to parameters/metrics for known alarm signals) if the audio signals are first determined to exceed a threshold signal strength/volume.

In one embodiment in which the alarm monitoring system 36 records audio signals of the various alarms during the training procedure, the alarm monitoring system 36 uses a suitable matching/identification algorithm to compare audio signals received during the monitor mode to the recorded audio signals. Alternatively (or additionally), in an embodiment in which the alarm monitoring system 36 generates alarm identification data for each alarm during the training procedure, the alarm monitoring system 36 processes audio signals received during the monitor mode in order to generate corresponding types of data (e.g., frequency data, period/rate data, signal strength data, other "fingerprint" data, etc.), and implements the audio recognition technique at least in part by comparing that data to the alarm identification data of the various alarms. In some embodiments, a match/alarm is identified when a particular threshold is surpassed. In one embodiment, for example, an audio signal received during the monitor mode is determined to correspond to (i.e., recognized as) water leak detector 26 if the tone frequency, tone repetition period, and/or signal strength of the audio signal all match, within predetermined percentages or amounts, corresponding parameters that were generated and associated with water leak detector 26 during the training procedure. More generally, any suitable using an audio recognition technique may be used to determine whether a monitored audio signal matches the audio signal of an alarm. For example, techniques similar to those currently used for song recognition (e.g., in smart phone applications) may be used to determine whether a monitored audio signal matches the audio signal of an alarm.

When the alarm monitoring system 36 determines that an audio signal received during the monitor mode corresponds to the known audio signal of an alarm in the home 12, the alarm monitoring system 36 generates a notification message, and causes that message to be sent to smart phone 52 (via network 50) to alert the home owner/resident. In various embodiments, the message is a text message, an email message, or any other suitable type of message, and contains an indication of the alarm (e.g., alarm type and/or location) corresponding to the detected audio signal. In one embodiment, for example, the message includes a copy of the alarm description entered by the home owner/resident during the training phase (e.g., "smoke detector, ground floor," etc.). In some embodiments, the message also includes other content, such as a picture or video taken by alarm monitoring system 36 after the alarm was detected. Additionally (or alternatively), in some embodiments, the alarm monitoring system 36 sends a similar message to other individuals or entities, such as a remote server maintained by a home security service, a fire or police department call center, etc.

In some embodiments and scenarios, the training process does not allow alarm monitoring system 36 to uniquely identify each alarm. For example, in one embodiment where training occurs at one or more locations different from the location (during monitor mode) of alarm monitoring system 36, and where smoke detectors 20 and 24 generate identical audio signals, alarm monitoring system 36 can notify the home owner/resident when a smoke detector has been triggered, but cannot identify or specify whether smoke detector 20 or smoke detector 24 was triggered.

In the "alarm generation mode," the alarm monitoring system 36 is initially trained to recognize a range of audio signals that is to be associated with "normal" conditions/occurrences within the home 12 (e.g., conditions/occurrences that are not high-risk). In various embodiments, the alarm monitoring system 36 processes audio signals detected within the home 12 over a relatively long training time period, such as one hour, one 24-hour day, one week, etc. The entire training time period may be continuous, or may include a plurality of non-contiguous time periods (e.g., 12 hours a day for one week, etc.). In some embodiments, it is preferable that the home owner/resident (and any other individuals) be absent from the home 12 during the training time period, so that the ambient noise profile does not account for noises that might result from a break-in, such as the sound of closing doors within the home 12, the sound of human conversation within the home 12, etc.

The alarm monitoring system 36 processes the audio signals received during the training time period, and generates various metrics, parameters or other data indicative of an "ambient noise profile" of the home 12 (i.e., indicative of audio signal characteristics within the home 12, from the perspective of the location of alarm monitoring system 36 during the training procedure). In one embodiment, for example, the alarm monitoring system 36 determines the maximum signal strength during the training time period. Additionally or alternatively, in an embodiment, the alarm monitoring system 36 determines the maximum signal strength within each of a plurality of frequency ranges during the training time period, the duration of audio signals above a particular signal strength during the training time period, and/or one or more other parameters/metrics corresponding to the training time period. In one embodiment in which the audio detection module 42 includes multiple, physically separated microphones, the alarm monitoring system 36 also stores information relating to the directionality of audio signals (e.g., for those audio signals above a particular signal strength) during the training time period.

After training has been completed, the home owner/resident may set the alarm monitoring system 36 to a monitor mode. In the monitor mode, the alarm monitoring system 36 listens to audio signals that are detectable at the position of audio detection module 42. In various embodiments, the alarm monitoring system 36 listens continuously, periodically (e.g., for two consecutive seconds once every five seconds, etc.), or on another suitable schedule (e.g., for one second every three seconds, or for a longer duration if a sufficiently strong audio signal is received during that one second, etc.), and processes the detected sounds.

The audio signals detected by the alarm monitoring system 36 are processed to determine whether a sound satisfies one or more criteria corresponding to an alarm condition. For example, a relatively simple alarm criterion may be that a high-risk situation exists if any detected audio signal has a signal strength greater than the maximum of all audio signal strengths detected during the training time period. As another example, alarm criteria may relate to both audio signal strength and frequency content (e.g., a high-risk situation is determined to exist if any detected audio signal is determined to simultaneously be (1) in a particular frequency band/range and (2) have at least double the signal power of any audio signal detected within that frequency band/range during the training time period). In this manner, for example, alarm criteria may be satisfied if a window is shattered in a distant room, but not satisfied if a telephone in very close proximity to audio detection module 42 starts ringing, even if the sound of the ringing telephone is louder at the location of audio detection module 42. As still another example, the alarm criteria may relate to audio signal strength and directionality (e.g., a high-risk situation is determined to exist if any detected audio signal is determined to simultaneously be (1) from a particular direction or area and (2) have greater than the maximum signal power of any audio signal detected from that direction or area during the training time period). Other suitable parameters, such as the length of time that an audio signal is above a threshold signal strength and/or within a particular frequency range, may also be used to determine whether alarm criteria are met. In embodiments in which multiple alarm criteria exist, the criteria may be either conjunctive (all criteria must be met) or disjunctive (only one criteria must be met), or a combination of both (e.g., only two of three criteria must be met, etc.).

When the alarm monitoring system 36 determines that the alarm criterion or criteria have been satisfied during the monitor mode, the alarm monitoring system 36 generates a notification message, and causes that message to be sent to smart phone 52 (via network 50) to alert the home owner/resident. In various embodiments, the message is a text message, an email message, or any other suitable type of message. The message may be a generic indication (e.g., the word "ALERT!"), or may include more information, such as which alarm criterion or criteria were satisfied by the alarm monitoring system 36, the time at which the corresponding audio signal was received by the alarm monitoring system 36, etc. In some embodiments, the message also includes other content, such as a picture or video taken by alarm monitoring system 36 after the alarm criterion or criteria was/were determined to be satisfied, and/or an audio recording of at least a portion of the particular audio signal that satisfied the alarm criterion or criteria. Additionally or alternatively, in some embodiments, the alarm monitoring system 36 sends a similar message to other individuals or entities, such as a remote server maintained by a home security service, a fire or police department call center, etc.

Although the alarm identification mode and the alarm generation mode have been described above as separate modes, in some embodiments the alarm monitoring system 36 is configured to function in both modes. For example, the alarm monitoring system 36 may be trained during a first time period to recognize each alarm within the home 12 for the alarm identification mode, trained during a second time period to learn the ambient noise profile of the home 12 for the alarm generation mode, and then set to a monitor mode for both the alarm identification mode and the alarm generation mode during a third time period.

Figure 2:
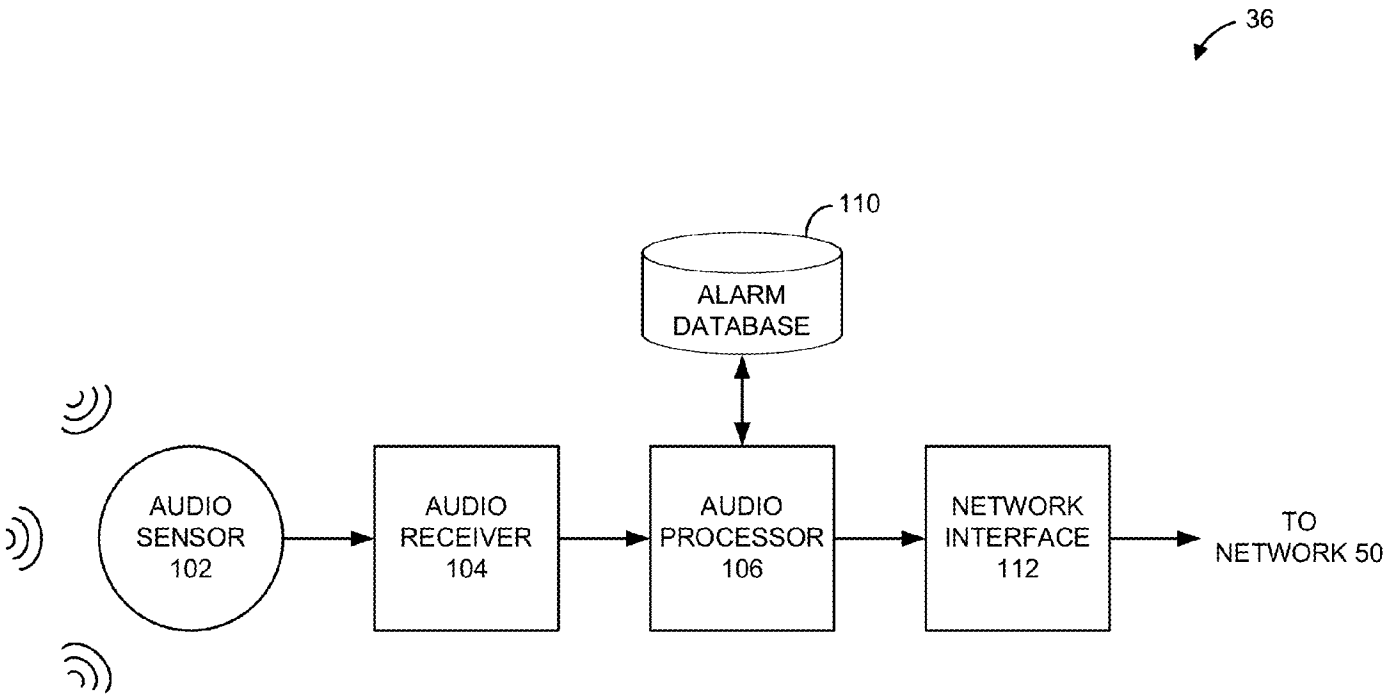
FIG. 2 is a more detailed block diagram of the alarm monitoring system in the system of FIG. 1, according to an embodiment.

FIG. 2 is a more detailed (though still greatly simplified) block diagram of the alarm monitoring system 36 in the system 10 of FIG. 1, according to one example embodiment. To detect audio signals from the environment of the home 12, the alarm monitoring system 36 includes an audio sensor(s) 102, which may include a microphone, or a group or array of two or more directional microphones, for example. The audio sensor(s) 102 may be included in the audio detection module 42 of FIG. 1, for example.

Coupled to the output of the audio sensor(s) 102 is an audio receiver 104. Audio receiver 104 may include analog amplifiers and/or filters, an analog-to-digital (ND) converter to convert analog audio signals detected by audio sensor(s) 102 to digital audio signals, and/or digital buffers and/or filters that operate on the converted signals. In some embodiments, the audio receiver 104 is also configured to obtain various metrics associated with received audio signals, such as signal strength, frequency, multi-path delay information, and/or directionality, for example. Such metrics may then be used to characterize the audio signals of various alarms, and to compare monitored audio signals to the known alarm audio signals (e.g., as discussed above in connection with FIG. 1). The audio receiver 104 may be included in the audio detection module 42 of FIG. 1 or the computer 40 of FIG. 1, or may be distributed between the audio detection module 42 and computer 40 of FIG. 1, for example.

Coupled to the output of the audio receiver 104 is an audio processor 106. In an embodiment, the audio processor 106 includes one or more physical processors that execute software or firmware instructions stored in a memory, such as random access memory (RAM) or read-only memory (ROM), for example. The audio processor 106 processes audio signals (received via audio sensor(s) 102 and audio receiver 104) using an audio recognition or other technique in order to perform the various operations of the alarm identification mode and/or alarm generation mode described above. For example, the audio processor 106 may process audio signals corresponding to various alarms in the home 12 during the training procedure of the alarm identification mode to generate appropriate parameters/metrics/fingerprints, and process audio signals during the ensuing monitor mode to generate corresponding parameters/metrics/fingerprints to identify whether any of the audio signals matches a known alarm. Additionally or alternatively, the audio processor 106 may process audio signals during the training time period of the alarm generation mode to generate data indicative of the ambient noise profile of the home 12, and process audio signals during the ensuing monitor mode to determine whether the audio signals are sufficiently different than the ambient noise profile to warrant sending the home owner/resident an alert. The audio processor 106 may be included in the audio detection module 42 of FIG. 1 or the computer 40 of FIG. 1, or may be distributed between the audio detection module 42 and computer 40 of FIG. 1, for example. In some embodiments, the audio processor 106 also performs additional functions, such as generating the content of the notifications/alert messages described above, and/or causing the messages to be sent to the home owner/resident. In other embodiments, a different processor/unit (not shown in FIG. 2) performs at least some of these additional functions.

Coupled to the audio processor 106 is an alarm database 110. The alarm database 110 is stored in one or more memories, such as RAM, ROM, FLASH memory, etc. (e.g., within computer 40 of FIG. 1). The audio processor 106 may store data generated from the alarm identification mode and/or alarm generation mode training procedure(s) in the alarm database 110. For example, the audio processor 106 may store parameters/metrics/fingerprints corresponding to alarms in the home 12 in the alarm database 110, along with the alarm descriptions and data associating the parameters/metrics/fingerprints with the respective alarm descriptions. Alternatively (or additionally), the audio processor 106 may store data indicative of the ambient noise profile of the home 12 in the alarm database 110. In some embodiments, the alarm database 110 stores not only data associated with the training procedure(s), but also data (e.g., parameter/metric/fingerprint data) generated based on audio signals detected during the monitor mode.

Coupled to the output of the audio processor 106 is a network interface 112, which enables the alarm monitoring system 36 to communicate with network 50 (and therefore smart phone 52) of FIG. 1. In one embodiment, the network interface 112 causes one or more of the notification/alert messages described above to be sent to smart phone 52 via network 50 (e.g., in response to a command, and/or message content, from audio processor 106 and/or a different processor). The network interface 112 may be included in the computer 40 of FIG. 1 (e.g., a network interface card of the computer 40), or may be distributed between the computer 40 and one or more devices externally coupled to the computer 50 (e.g., router and/or modem devices), for example.

Figure 3:
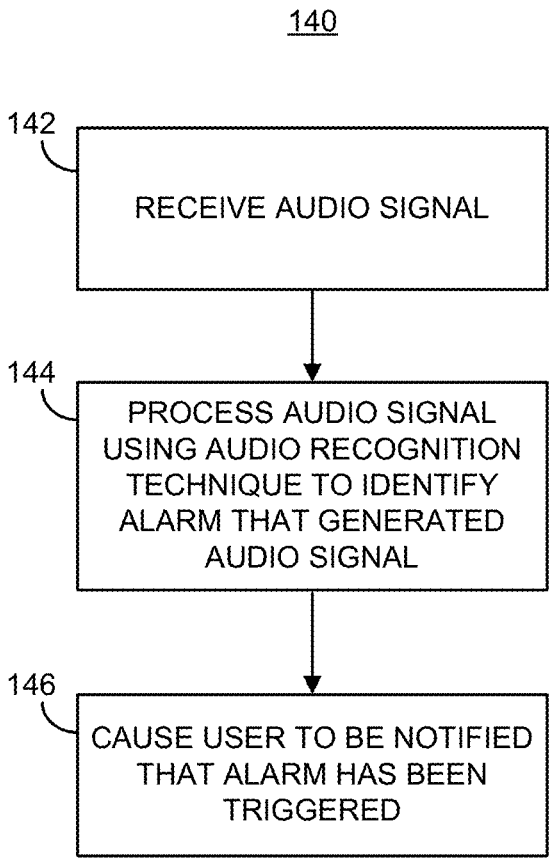
FIG. 3 is a flow diagram of an example method for remote monitoring in an alarm identification mode, according to an embodiment.

FIG. 3 is a flow diagram of an example method 140 for remote monitoring in the alarm identification mode, according to an embodiment. In an embodiment, the method 140 is implemented by the alarm monitoring system 36 of FIGS. 1 and 2. More specifically, in such an embodiment, the method 140 may be implemented by the audio processor 106 (e.g., within the computer 40, the audio detection module 42, or both).

In the example method 140, an audio signal is received (block 142). In one embodiment, the audio signal is a digital audio signal. For example, the method 140 may include additional blocks, prior to block 142 and not shown in FIG. 3, in which an analog audio signal is detected via an audio sensor (e.g., via audio sensor(s) 102 of FIG. 2), and the detected analog audio signal is converted to the digital audio signal (e.g., via audio receiver 104 of FIG. 2). In various embodiments and/or scenarios, the audio signal may be received during a single, continuous time period, or over the course of a plurality of non-contiguous time periods.

After the audio signal is received (block 142), the audio signal is processed using an audio recognition technique to identify the alarm that generated the audio signal (block 144). In some embodiments, sounds at frequencies outside the range of human hearing (e.g., including ultrasonic sounds), such as a "whistle" produced by a failing pump or appliance, are processed in addition to (or instead of) sounds that are at frequencies detectable by the human ear. In other embodiments, only sounds that are generally within the range of human hearing are processed. The alarm may be identified by type (e.g., smoke detector, carbon monoxide detector, etc.), location (e.g., basement, smoke detector in basement, etc.), or any other suitably distinguishing label or parameter (e.g., a unique identification number). In one embodiment and scenario, the identified alarm is any one or more of the alarm devices/systems of FIG. 1 (e.g., smoke detector 20 and/or 24, carbon monoxide detector 22, water leak detector 26, and/or home security system 30, 34A-34J). It is understood that, in embodiments where the received audio signal is a digital audio signal, the identified alarm did not directly generate the digital audio signal, but rather generated an analog version of the audio signal prior to A/D conversion.

As discussed above in connection with FIG. 1, a received audio signal may be processed in various ways, according to various different audio recognition techniques, in order to identify the alarm that generated the audio signal. For example, the audio signal may be compared to known alarm audio signals by utilizing alarm identification data and/or recordings that was/were generated during an earlier, training procedure. In one embodiment, for example, the method 140 includes additional blocks, prior to block 142, in which a set of one or more audio test signals generated by the alarm is received and then processed to generate alarm identification data, and/or recorded. In an alternative embodiment, the method 140 includes an additional block, prior to block 142 and not shown in FIG. 3, in which alarm identification data associated with the alarm is received from an external source. For example, the alarm identification data may be received from a server associated with a vendor or manufacturer of the alarm. As another example, the alarm identification data may be received from a smart phone (e.g., smart phone 52 of FIG. 1) that was used to train the system. In one embodiment, the audio recognition technique is similar to techniques currently used for song recognition (e.g., in smart phone applications).

As was also discussed above, a description (e.g., indication of type and/or location) of the alarm may additionally be used to identify the alarm that generated the audio signal. To this end, the method 140 may include an additional block, prior to block 142 and not shown in FIG. 3, in which an indication of alarm type and/or location is received via a user interface (e.g., a user interface of computer 40 or smart phone 52).

After the alarm has been identified (block 144), a user is caused to be notified that the alarm has been triggered (block 146). The user may be an owner or other resident of the home in which the alarm is located, an employee associated with a facility (e.g., store or warehouse) in which the alarm is located, an employee at a call center, or any other individual. In various embodiments, the notification includes an email message, a text message, an outbound alert to the user's telephone, an alert to a social media account of the user, and/or any other suitable message type. The notification may indicate that the identified alarm has been triggered in various ways. For example, the notification may provide a copy of an alarm description entered by a home owner/resident, such as "smoke detector," "smoke detector, basement," etc. As another example, the notification may provide only a generalized alert, such as a text message stating "ALERT!" In some embodiments, the notification also includes other content, such as a picture or video of the home or other structure/area in which the alarm is located. The notification may be caused to be sent to the user in any suitable manner, such as providing the notification content to a network interface (e.g., network interface 112 of FIG. 2) and/or instructing the network interface to send the notification content within the text message, email message, etc.

The example method 140 of FIG. 3 corresponds to a scenario in which an alarm has been triggered, and so the received audio signal was generated by the alarm. It is understood, however, that audio signals may be received on a continuous (or periodic, etc.) basis, with blocks similar to blocks 144 and 146 only being implemented for audio signals that were generated by known alarms.

Figure 4:
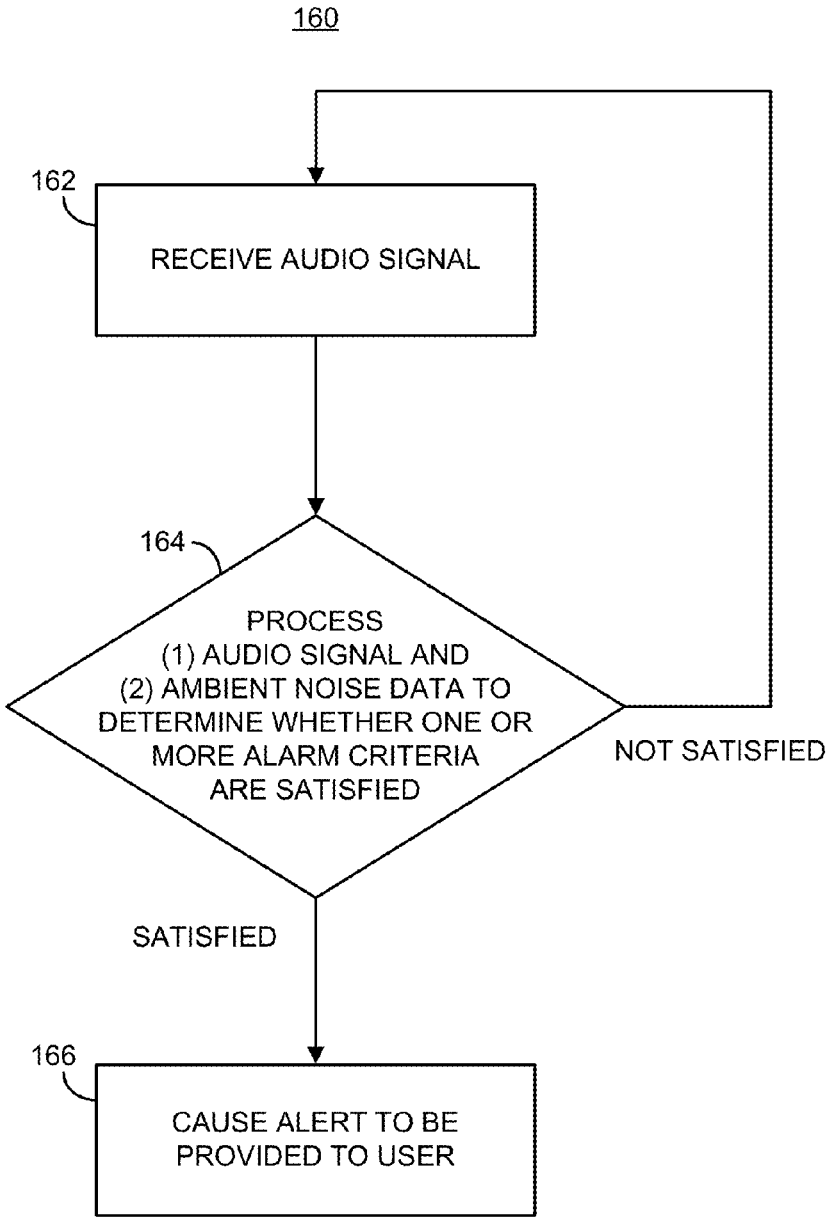
FIG. 4 is a flow diagram of an example method for remote monitoring in an alarm generation mode, according to an embodiment.

FIG. 4 is a flow diagram of an example method 160 for remote monitoring in the alarm generation mode, according to an embodiment. In an embodiment, the method 160 is implemented by the alarm monitoring system 36 of FIGS. 1 and 2. More specifically, in such an embodiment, the method 160 may be implemented by the audio processor 106 (e.g., within the computer 40, the audio detection module 42, or both).

In the example method 160, an audio signal is received (block 162). In one embodiment, the audio signal is a digital audio signal. For example, the method 160 may include additional blocks, prior to block 162 and not shown in FIG. 4, in which an analog audio signal is detected via an audio sensor (e.g., via audio sensor(s) 102 of FIG. 2), and the detected analog audio signal is converted to the digital audio signal (e.g., via audio receiver 104 of FIG. 2). In various embodiments and/or scenarios, the audio signal may be received during a single, continuous time period, or over the course of a plurality of non-contiguous time periods.

After the audio signal is received (block 162), the audio signal is processed along with ambient noise data (block 164) to determine whether one or more alarm criteria are satisfied. In some embodiments, sounds at frequencies outside the range of human hearing (e.g., including ultrasonic sounds) are processed in addition to (or instead of) sounds that are at frequencies detectable by the human ear. In other embodiments, only sounds that are generally within the range of human hearing are processed.

The ambient noise data is indicative of an ambient noise profile of an area in which the audio sensor that initially detects the audio signal (e.g., before the audio signal is converted to a digital signal) is located. The ambient noise profile may correspond to sounds within a home such as the home 12 of FIG. 1, sounds within a commercial building or other type of structure, or sounds within an outdoor area. In some embodiments, the method 160 includes additional blocks, prior to block 162 and not shown in FIG. 4, in which a set of one of one or more ambient noise signals is received over a continuous or non-continuous training time period, and then processed to generate the ambient noise data. In an alternative embodiment, the ambient noise data may be received from a smart phone (e.g., smart phone 52 of FIG. 1) that executed an application to generate the ambient noise data based on the ambient noise signals.

The received audio signal and the ambient noise data are processed at least in part by calculating a measure of a difference between the audio signal and the ambient noise profile of the area. As discussed above in connection with FIG. 1, the difference may be calculated in various ways. In one embodiment where the method 160 generates the ambient noise data based on a received set of one or more ambient noise signals, for example, a measure of a difference between (1) an audio signal strength associated with the received audio signal and (2) an audio signal strength associated with the set of ambient noise signals is calculated, and then compared to a threshold. Thereafter, in one embodiment, it is determined that an alarm criterion is satisfied if a peak or average signal strength of the received audio signal differs more than a predetermined threshold amount or percentage from a peak or average signal strength of the ambient noise signals. In other embodiments, different and/or more complex criteria (e.g., involving signal strength, frequency, directionality, etc.) are utilized, and/or multiple conjunctive and/or disjunctive criteria are utilized, as discussed above in connection with FIG. 1.

In some embodiments, the method 160 includes an additional block, between blocks 162 and 164 and not shown in FIG. 4, in which the received audio signal is "pre-processed" to determine whether full processing at block 164 should be implemented. For example, it may be determined whether the received audio signal has greater than a threshold signal strength, with flow proceeding to block 164 only for high signal strength audio signals (and returning to block 162 otherwise).

If it is determined that the one or more alarm criteria are not satisfied (block 164), flow proceeds back to the start of method 160, where a subsequent audio signal is received (block 162) and processed (block 164).

If it is determined that the one or more alarm criteria are satisfied (block 164), an alert is caused to be provided to a user (block 166). The user may be an owner or other resident of a home in which the system or device implementing the method 160 is located, an employee associated with a facility (e.g., store or warehouse) in which the system or device is located, an employee at a call center, or any other individual. In various embodiments, the notification includes an email message, a text message, and/or any other suitable message type. The notification may indicate that the one or more alarm criteria have been satisfied in various ways. For example, the notification may expressly state which criterion or criteria have been satisfied (e.g., "greater than peak signal strength detected in frequency band X"), more generally indicate the satisfied criterion or criteria (e.g., "unusually loud noise detected"), provide only a generalized alert (e.g., a text message stating "ALERT!"), etc. In some embodiments, the notification also includes other content, such as a picture, video and/or audio recording from the home or other structure/area being monitored. The notification may be caused to be sent to the user in any suitable manner, such as providing the notification message content to a network interface (e.g., network interface 112 of FIG. 2) and/or instructing the network interface to send the notification message content within a text message, email message, etc.

Blocks 162 and 164 (and in some scenarios, block 166) may be repeated multiple times. For example, audio signals may be received and processed on a substantially continuous or other (e.g., periodic) basis.

Figure 5:
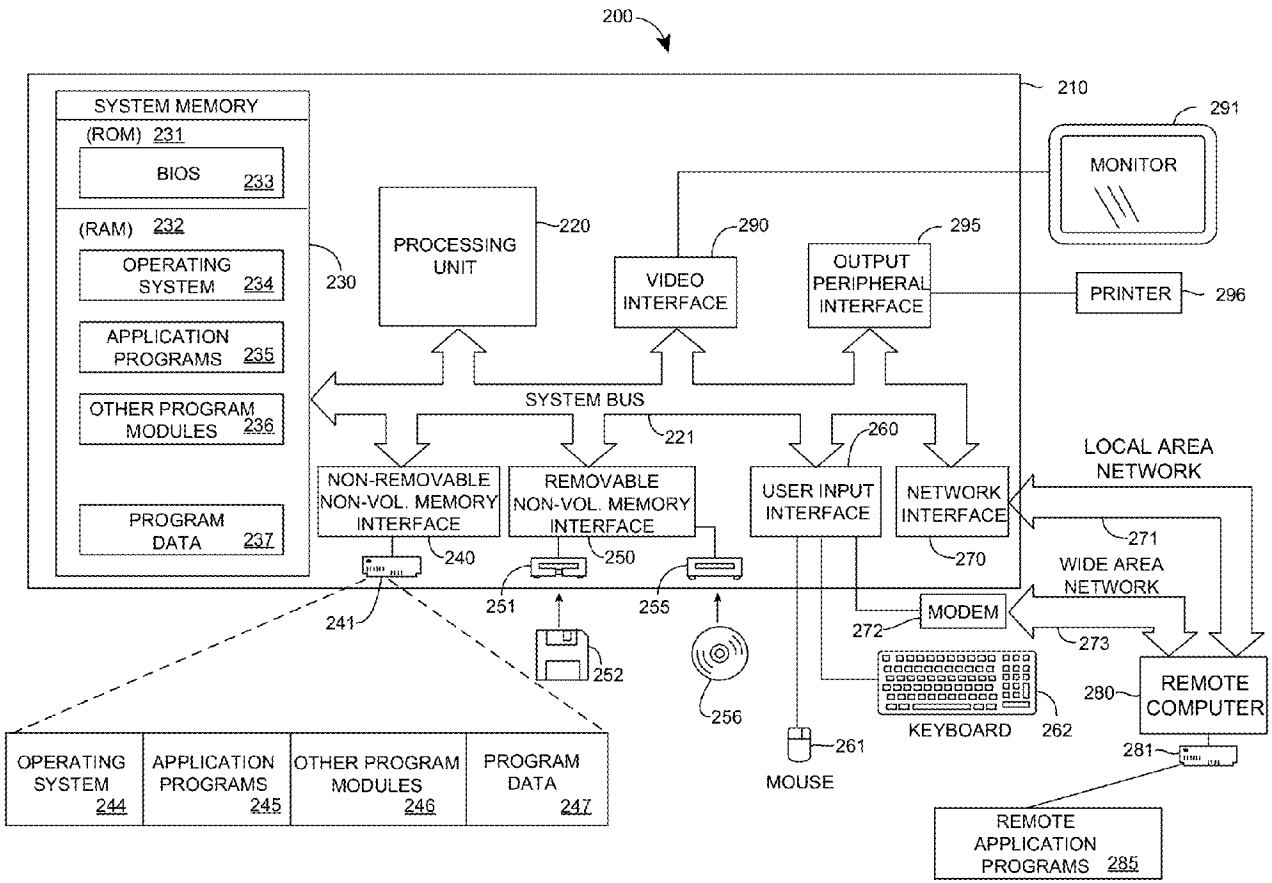
FIG. 5 illustrates a block diagram of an example computer system on which an example method for identifying an alarm that has been triggered, generating an alarm, and/or notifying a user that an alarm has been triggered may operate in accordance with the described embodiments.

FIG. 5 illustrates a block diagram of an example computer system 200 on which an example method for identifying an alarm that has been triggered, generating an alarm, and/or notifying a user that an alarm has been triggered may operate in accordance with the described embodiments. The computer system 200 of FIG. 5 includes a computing device in the form of a computer 210. Components of the computer 210 may include, but are not limited to, a processing unit 220, a system memory 230, and a system bus 221 that couples various system components, including the system memory to the processing unit 220. The system bus 221 may be any of several types of bus structures including a memory bus or memory controller, a peripheral bus, and a local bus using any of a variety of bus architectures. By way of example, and not limitation, such architectures include the Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus (also known as Mezzanine bus).

Computer 210 typically includes a variety of computer-readable media. Computer-readable media can be any available media that can be accessed by computer 210 and includes both volatile and nonvolatile media, and both removable and non-removable media. By way of example, and not limitation, computer-readable media may comprise computer storage media and communication media. Computer storage media includes volatile and nonvolatile, removable and non-removable media implemented in any method or technology for storage of information such as computer-readable instructions, data structures, program modules or other data. Computer storage media includes, but is not limited to, RAM, ROM, EEPROM, FLASH memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer 210. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency (RF), infrared and other wireless media. Combinations of any of the above are also included within the scope of computer-readable media.

The system memory 230 includes computer storage media in the form of volatile and/or nonvolatile memory such as ROM 231 and RAM 232. A basic input/output system 233 (BIOS), containing the basic routines that help to transfer information between elements within computer 210, such as during start-up, is typically stored in ROM 231. RAM 232 typically contains data and/or program modules that are immediately accessible to and/or presently being operated on by processing unit 220. By way of example, and not limitation, FIG. 5 illustrates operating system 234, application programs 235, other program modules 236, and program data 237.

The computer 210 may also include other removable/non-removable, volatile/nonvolatile computer storage media. By way of example only, FIG. 5 illustrates a hard disk drive 241 that reads from or writes to non-removable, nonvolatile magnetic media, a magnetic disk drive 251 that reads from or writes to a removable, nonvolatile magnetic disk 252, and an optical disk drive 255 that reads from or writes to a removable, nonvolatile optical disk 256 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 241 is typically connected to the system bus 221 through a non-removable memory interface such as interface 240, and magnetic disk drive 251 and optical disk drive 255 are typically connected to the system bus 221 by a removable memory interface, such as interface 250.

The drives and their associated computer storage media discussed above and illustrated in FIG. 5 provide storage of computer-readable instructions, data structures, program modules and other data for the computer 210. In FIG. 5, for example, hard disk drive 241 is illustrated as storing operating system 244, application programs 245, other program modules 246, and program data 247. Note that these components can either be the same as or different from operating system 234, application programs 235, other program modules 236, and program data 237. Operating system 244, application programs 245, other program modules 246, and program data 247 are given different numbers here to illustrate that, at a minimum, they are different copies. A user may enter commands and information into the computer 210 through input devices such as a keyboard 262 and cursor control device 261, commonly referred to as a mouse, trackball or touch pad. A monitor 291 or other type of display device is also connected to the system bus 221 via an interface, such as a graphics controller 290. In addition to the monitor, computers may also include other peripheral output devices such as printer 296, which may be connected through an output peripheral interface 295.

The computer 210 may operate in a networked environment using logical connections to one or more remote computers, such as a remote computer 280. The remote computer 280 may be a personal computer, a server, a router, a network PC, a peer device or other common network node, and typically includes many or all of the elements described above relative to the computer 210, although only a memory storage device 281 has been illustrated in FIG. 5. The logical connections depicted in FIG. 5 include a local area network (LAN) 271 and a wide area network (WAN) 273, but may also include other networks. Such networking environments are commonplace in hospitals, offices, enterprise-wide computer networks, intranets and the Internet.

When used in a LAN networking environment, the computer 210 is connected to the LAN 271 through a network interface or adapter 270. When used in a WAN networking environment, the computer 210 typically includes a modem 272 or other means for establishing communications over the WAN 273, such as the Internet. The modem 272, which may be internal or external, may be connected to the system bus 221 via the input interface 260, or other appropriate mechanism. In a networked environment, program modules depicted relative to the computer 210, or portions thereof, may be stored in the remote memory storage device 281. By way of example, and not limitation, FIG. 5 illustrates remote application programs 285 as residing on memory device 281.

The communications connections 270, 272 allow the device to communicate with other devices. The communications connections 270, 272 are an example of communication media, as discussed above.

Any of the methods of identifying an alarm that has been triggered, generating an alarm and/or notifying a user that an alarm has been triggered that are described above may be implemented in part, or in their entirety, using one or more computer systems such as the computer system 200 illustrated in FIG. 5. For example, audio signals may be detected during training and/or monitor modes, as described above, by an audio sensor (e.g., microphone(s)) of the computer 210, or by an audio sensor of each of one or more devices coupled to the computer 210 (e.g., coupled to system bus 221 via a peripheral interface not shown in FIG. 5), and/or alarm description data may be entered by a user via keyboard 262 (and/or mouse 261) and user input interface 260. As another example, the processing unit 220 may cause the network interface 270 to send a notification/alert to a user (in the manner described above) via the WAN 273, LAN 271, and/or one or more other networks.

Some or all calculations performed in the system embodiments described above (e.g., calculations for determining whether an audio signal corresponds to a known alarm, calculations for determining a difference between an audio signal and an ambient noise profile of a home, etc.) may be performed by a computer such as the computer 210, and more specifically may be performed by a processor such as the processing unit 220, for example. The processing unit 220 (or a peripheral device coupled to system bus 221 via a peripheral interface, such as a USB interface) may implement the functions of audio processor 106 described above in connection with FIGS. 1 and 2, the operations of method 140 of FIG. 3, and/or the operations of method 160 of FIG. 4, for example. In some embodiments, some calculations may be performed by a first computer such as the computer 210 while other calculations may be performed by one or more other computers such as the remote computer 280. The calculations may be performed according to instructions that are part of a program such as the application programs 235, the application programs 245 and/or the remote application programs 285, for example.

I claim:

1. A computer-implemented method for remote monitoring of one or more alarms, the method comprising:

receiving a set of one or more audio test signals generated by an alarm device;

at least one of (i) processing the received set of audio test signals to generate alarm identification data, or (ii) recording the received set of audio test signals;

receiving, via a user interface, an indication of one or both of (i) a type of the alarm device, and (ii) a location of the alarm device;

sensing an audio signal that was generated by the alarm device in response to detecting an alarm condition;

generating a digital audio signal based on the sensed audio signal;

receiving, via one or more processors, the digital audio signal;

processing, via one or more processors and using an audio recognition technique, the received digital audio signal to identify the alarm device that generated the audio signal, wherein processing the received digital audio signal to identify the alarm device that generated the audio signal includes identifying the alarm device that generated the audio signal using at least one of (i) the generated alarm identification data, or (ii) the recorded set of audio test signals, and the received indication; and causing, via one or more processors, a user to be notified that the identified alarm device has been triggered.

2. The computer-implemented method of claim 1, wherein processing the received digital audio signal to identify the alarm device that generated the audio signal includes processing the received digital audio signal to identify (i) a smoke detector located at a residence of the user, (ii) a carbon monoxide detector located at the residence of the user, (iii) a water leak detector located at the residence of the user, (iv) a home security system located at the residence of the user, (v) a door alarm device located at the residence of the user, (vi) a window alarm device located at the residence of the user, or (vii) mechanical equipment located at the residence of the user.

3. The computer-implemented method of claim 1, wherein causing a user to be notified that the identified alarm device has been triggered includes causing at least one of (i) an electronic mail message indicating that the identified alarm device has been triggered to be sent to the user, (ii) a text message indicating that the identified alarm device has been triggered to be sent to the user, (iii) an outbound telephone alert, or (iv) a social media alert.

4. A computer-implemented method for alarm generation and notification, the method comprising:

receiving, via one or more processors, a set of one or more ambient noise signals;

processing, via one or more processors, the received set of ambient noise signals to generate ambient noise data indicative of an ambient noise profile of an area;

sensing an audio signal within the area;

generating a digital audio signal based on the sensed audio signal;

receiving, via one or more processors, the digital audio signal;

processing, via one or more processors, (i) the received digital audio signal, and (ii) the ambient noise data to determine whether one or more alarm criteria have been satisfied, wherein processing the received digital audio signal and the ambient noise data includes calculating a measure of a difference between an audio signal strength associated with the received digital audio signal and an audio signal strength associated with the received set of ambient noise signals, and comparing the calculated measure to a threshold; and in response to determining that the one or more alarm criteria have been satisfied, causing, via one or more processors, an alert to be provided to a user.

5. The computer-implemented method of claim 4, wherein causing an alert to be provided to the user includes causing at least one of (i) an electronic mail, (ii) a text message, (iii) an outbound telephone alert, or (iv) a social media alert, to be sent to the user.

6. A non-transitory computer-readable storage medium comprising computer-readable instructions to be executed on one or more processors of a system for alarm generation and notification, the instructions when executed causing the one or more processors to:

receive a set of one or more ambient noise signals;

process the received set of ambient noise signals to generate ambient noise data indicative of an ambient noise profile of an area;

receive a digital audio signal that was generated based on an audio signal sensed within the area;

process (i) the received digital audio signal, and (ii) the ambient noise data to determine whether one or more alarm criteria have been satisfied, wherein the instructions cause to one or more processors to process the received digital audio signal and the ambient noise data at least by calculating a measure of a difference between an audio signal strength associated with the received digital audio signal and an audio signal strength associated with the received set of ambient noise signals, and comparing the calculated measure to a threshold; and in response to determining that the one or more alarm criteria have been satisfied, cause an alert to be provided to a user.

7. The non-transitory computer-readable storage medium of claim 6, wherein the instructions cause the one or more processors to cause an alert to be provided to the user at least by causing at least one of (i) an electronic mail message, (ii) a text message, (iii) an outbound telephone alert, or (iv) a social media alert, to be sent to the user.

8. A computer-implemented method for remote monitoring of one or more alarms, the method comprising:

receiving alarm identification data associated with an alarm device;

receiving an indication of one or both of (i) a type of the alarm device, and (ii) a location of the alarm device;

sensing an audio signal that was generated by the alarm device in response to detecting an alarm condition;

generating a digital audio signal based on the sensed audio signal;

receiving, via one or more processors, the digital audio signal;

processing, via one or more processors and using an audio recognition technique, the received digital audio signal to identify the alarm device that generated the audio signal, wherein processing the received digital audio signal to identify the alarm device that generated the audio signal includes identifying the alarm device that generated the audio signal using (i) the received alarm identification data and (ii) the received indication; and causing, via one or more processors, a user to be notified that the identified alarm device has been triggered.

9. The computer-implemented method of claim 8, wherein processing the received digital audio signal to identify the alarm device that generated the audio signal includes processing the received digital audio signal to identify (i) a smoke detector located at a residence of the user, (ii) a carbon monoxide detector located at the residence of the user, (iii) a water leak detector located at the residence of the user, (iv) a home security system located at the residence of the user, (v) a door alarm device located at the residence of the user, (vi) a window alarm device located at the residence of the user, or (vii) mechanical equipment located at the residence of the user.

10. The computer-implemented method of claim 8, wherein causing a user to be notified that the identified alarm device has been triggered includes causing at least one of (i) an electronic mail message indicating that the identified alarm device has been triggered to be sent to the user, (ii) a text message indicating that the identified alarm device has been triggered to be sent to the user, (iii) an outbound telephone alert, or (iv) a social media alert.

* * * * *